US010077938B2

(12) United States Patent
Mak

(10) Patent No.: US 10,077,938 B2
(45) Date of Patent: Sep. 18, 2018

(54) METHODS AND CONFIGURATION OF AN NGL RECOVERY PROCESS FOR LOW PRESSURE RICH FEED GAS

(71) Applicant: Fluor Technologies Corporation, Sugar Land, TX (US)

(72) Inventor: John Mak, Santa Ana, CA (US)

(73) Assignee: Fluor Technologies Corporation, Sugar Land, TX (US)

( * ) Notice: Subject to any disclaimer, the term of this patent is extended or adjusted under 35 U.S.C. 154(b) by 135 days.

(21) Appl. No.: 15/019,570

(22) Filed: Feb. 9, 2016

(65) Prior Publication Data

US 2016/0231052 A1 Aug. 11, 2016

Related U.S. Application Data

(60) Provisional application No. 62/113,938, filed on Feb. 9, 2015.

(51) Int. Cl.

| | |
|---|---|
| ***F25J 3/00*** | (2006.01) |
| ***F25J 3/02*** | (2006.01) |
| ***C10L 3/12*** | (2006.01) |

(52) U.S. Cl.

CPC ..... *F25J 3/0242* (2013.01); *C10L 3/12* (2013.01); *F25J 3/0209* (2013.01); *F25J 3/0233* (2013.01);

(Continued)

(58) Field of Classification Search

CPC ..... F25J 3/0209; F25J 3/0214; F25J 3/0233; F25J 3/0238; F25J 3/0242; F25J 2215/60;

(Continued)

(56) References Cited

U.S. PATENT DOCUMENTS 4,617,039 A 10/1986 Buck
4,657,571 A * 4/1987 Gazzi ..... C07C 7/005 62/621

(Continued)

FOREIGN PATENT DOCUMENTS

AR 103703 A1 5/2017
WO 2016130574 A1 8/2016

OTHER PUBLICATIONS

PCT Application No. PCT/US16/17190, International Search Report and Written Opinion, dated Jul. 1, 2016, 11 pages.

(Continued)

*Primary Examiner* — Keith Raymond
(74) *Attorney, Agent, or Firm* — Conley Rose, PC

(57) ABSTRACT

Separating propane and heavier hydrocarbons from a feed stream by cooling the feed stream, introducing the chilled feed stream into a feed stream separation unit, pumping the separator bottom stream, introducing the pressurized separator bottom stream into a stripper column, reducing the pressure of the separator overhead stream, introducing the letdown separator overhead stream into an absorber column, collecting a stripper overhead stream from the stripper column, chilling the stripper overhead stream, reducing the pressure of the chilled stripper overhead stream, introducing the letdown stripper overhead stream into the absorber column, collecting an absorber bottom stream, pumping the absorber bottom stream, heating the absorber bottom stream, introducing the heated absorber bottom stream into the stripper column, and collecting the stripper bottom stream from the stripper column. The stripper column bottom stream includes the propane and heavier hydrocarbons and less than about 2.0% of ethane by volume.

21 Claims, 3 Drawing Sheets

(52) U.S. Cl.
CPC ..... *F25J 3/0238* (2013.01); *F25J 2200/02* (2013.01); *F25J 2200/04* (2013.01); *F25J 2200/70* (2013.01); *F25J 2200/76* (2013.01); *F25J 2200/78* (2013.01); *F25J 2205/04* (2013.01); *F25J 2215/02* (2013.01); *F25J 2215/62* (2013.01); *F25J 2230/60* (2013.01); *F25J 2240/02* (2013.01); *F25J 2245/02* (2013.01); *F25J 2270/12* (2013.01); *F25J 2270/60* (2013.01); *F25J 2280/02* (2013.01)

(58) Field of Classification Search
CPC .. F25J 2215/62; F25J 2215/64; F25J 2205/04; F25J 2200/70; F25J 2200/220078; F25J 2240/02; F25J 2240/40; F25J 2210/06; F25J 2210/60; F25J 2210/62
See application file for complete search history.

(56) References Cited

U.S. PATENT DOCUMENTS

| | | | | |
|---|---|---|---|---|
| 5,555,748 | A | 9/1996 | Campbell et al. | |
| 5,685,170 | A | 11/1997 | Sorensen | |
| 5,881,569 | A * | 3/1999 | Campbell | F25J 3/0209 62/621 |
| 6,182,469 | B1 | 2/2001 | Campbell et al. | |
| 6,311,516 | B1 * | 11/2001 | Key | F25J 3/0209 62/619 |
| 6,601,406 | B1 | 8/2003 | Deng et al. | |
| 6,658,893 | B1 * | 12/2003 | Mealey | F25J 3/0209 62/619 |
| 6,837,070 | B2 | 1/2005 | Mak | |
| 6,915,662 | B2 | 7/2005 | Wilkinson et al. | |
| 7,051,552 | B2 | 5/2006 | Mak | |
| 7,051,553 | B2 | 5/2006 | Mak et al. | |
| 7,073,350 | B2 | 7/2006 | Mak | |
| 7,192,468 | B2 | 3/2007 | Mak et al. | |
| 7,377,127 | B2 | 5/2008 | Mak | |
| 7,424,808 | B2 | 9/2008 | Mak | |
| 7,574,856 | B2 | 8/2009 | Mak | |
| 7,597,746 | B2 | 10/2009 | Mak et al. | |
| 7,600,396 | B2 | 10/2009 | Mak | |
| 7,635,408 | B2 | 12/2009 | Mak et al. | |
| 7,637,987 | B2 | 12/2009 | Mak | |
| 7,674,444 | B2 | 3/2010 | Mak | |
| 7,713,497 | B2 | 5/2010 | Mak | |
| 7,785,480 | B2 | 8/2010 | Mak et al. | |
| 7,856,847 | B2 | 12/2010 | Patel et al. | |
| 7,980,081 | B2 | 7/2011 | Mak | |
| 8,065,890 | B2 | 11/2011 | Mak | |
| 8,110,023 | B2 | 2/2012 | Mak et al. | |
| 8,117,852 | B2 | 2/2012 | Mak | |
| 8,142,648 | B2 | 3/2012 | Mak | |
| 8,147,787 | B2 | 4/2012 | Mak et al. | |
| 8,192,588 | B2 | 6/2012 | Mak | |
| 8,196,413 | B2 | 6/2012 | Mak | |
| 8,209,996 | B2 | 7/2012 | Mak | |
| 8,316,665 | B2 | 11/2012 | Mak | |
| 8,377,403 | B2 | 2/2013 | Mak | |
| 8,398,748 | B2 | 3/2013 | Mak | |
| 8,480,982 | B2 | 7/2013 | Mak et al. | |
| 8,505,312 | B2 | 8/2013 | Mak | |
| 8,567,213 | B2 | 10/2013 | Mak | |
| 8,635,885 | B2 | 1/2014 | Mak | |
| 8,661,820 | B2 | 3/2014 | Mak | |
| 8,677,780 | B2 | 3/2014 | Mak | |
| 8,695,376 | B2 | 4/2014 | Mak | |
| 8,696,798 | B2 | 4/2014 | Mak | |
| 8,826,673 | B2 | 9/2014 | Mak | |
| 8,840,707 | B2 | 9/2014 | Mak | |
| 8,845,788 | B2 | 9/2014 | Mak | |
| 8,876,951 | B2 | 11/2014 | Mak | |
| 8,893,515 | B2 | 11/2014 | Mak | |
| 8,910,495 | B2 | 12/2014 | Mak | |
| 8,919,148 | B2 | 12/2014 | Wilkinson et al. | |
| 8,950,196 | B2 | 2/2015 | Mak | |
| 9,103,585 | B2 | 8/2015 | Mak | |
| 9,114,351 | B2 | 8/2015 | Mak | |
| 9,132,379 | B2 | 9/2015 | Mak | |
| 9,248,398 | B2 | 2/2016 | Mak | |
| 2004/0148964 | A1 | 8/2004 | Patel | |
| 2005/0255012 | A1 | 11/2005 | Mak | |
| 2011/0174017 | A1 * | 7/2011 | Victory | F25J 3/0209 62/620 |
| 2014/0182331 | A1 * | 7/2014 | Burmberger | F25J 1/0022 62/630 |
| 2014/0260420 | A1 | 9/2014 | Mak | |

OTHER PUBLICATIONS

PCT Application No. PCT/US16/17190, International Preliminary Report on Patentability, dated Aug. 24, 2017, 7 pages.
Europe Patent Application No. 16749733.8, Communication Pursuant to Rules 161(2) and 162 EPC, dated Sep. 15, 2017, 2 pages.

* cited by examiner

METHODS AND CONFIGURATION OF AN NGL RECOVERY PROCESS FOR LOW PRESSURE RICH FEED GAS

CROSS-REFERENCE TO RELATED APPLICATIONS

The subject matter disclosed herein is related generally to the subject matter disclosed in U.S. Provision Patent Application No. 62/113,938, filed on Feb. 9, 2015, and entitled "Methods and configuration of an NGL recovery process for low pressure rich feed gas," which is incorporated herein by reference in its entirety.

FIELD OF INVENTION

The subject matter disclosed herein generally relates to devices and methods for the separation of a natural gas stream, for example, a "rich" natural gas stream into an ethane product, a propane plus natural gas liquids (NGL) product, and a residue gas stream. In one or more of the embodiments disclosed herein, the natural gas stream may be separated at a relatively low pressure. Also in one or more of the embodiments disclosed herein, operation of the disclosed devices and methods allows for recovery of at least about 90% of the ethane and at least about 95% of the propane from the natural gas stream being processed. In one or more of the embodiments disclosed herein, operation of the disclosed devices and methods provides the need for the ethane recovery and ethane rejection operations, and the associated system components, of conventional separation systems and methods.

BACKGROUND

Natural gas is produced from various geological formations. Natural gas produced from various geological formations typically contains methane, ethane, propane, and heavier hydrocarbons, as well as trace amounts of various other gases such as nitrogen, carbon dioxide, and hydrogen sulfide. The various proportions of methane, ethane, propane, and the heavier hydrocarbons may vary, for example, depending upon the geological formation from which the natural gas is produced.

Natural gas comes from both "conventional" and "unconventional" geological formations. Conventionally-produced natural gas, or "free gas," is typically produced from formations where gas is trapped in multiple, relatively small, porous zones in various naturally occurring rock formations such as carbonates, sandstones, and siltstones. Conventionally-produced natural gas is generally produced from deep reservoirs and may either be associated with crude oil or be associated with little or no crude oil. Such conventionally-produced natural gas typically comprises from about 70 to 90% methane and from 5 to 10% ethane, with the balance being propane, heavier hydrocarbons, and trace amounts of various other gases (nitrogen, carbon dioxide, and hydrogen sulfide). These gas streams are termed "lean," meaning that this natural gas typically contains from about 3 to 5 gallons of ethane and heavier hydrocarbons per thousand standard cubic feet of gas (GPM). Such conventionally-produced natural gas streams are generally supplied as a feed gas stream to a natural gas processing plant (e.g., a NGL recovery plant) at a relatively high pressure, typically at about 900 to 1200 psig. Generally, natural gas processing plants (e.g., NGL recovery plants) are configured to process such conventionally-produced gas.

Unconventionally-produced gas is generally produced from formations including coal seams (also known as coal-bed methane, CBM), tight gas sands, geo-pressurized aquifers, and shale gas. These unconventional reservoirs may contain large quantities of natural gas, but are considered more difficult to produce as compared to conventional reservoir rocks. With recent advances in hydraulic fracking and horizontal drilling, these gas streams can be economically recovered. Such advances have triggered a surge in shale gas exploration (e.g., an unconventional natural gas reservoir). In some gas shales, for example, in the upper northwestern regions in the United States, the natural gas produced from such unconventional reservoirs can be very rich, for example, containing about 50 to 70% methane, 10 to 30% ethane with the balance in propane, heavier hydrocarbons, and trace amounts of various other gases (nitrogen, carbon dioxide, and hydrogen sulfide). These rich gas streams contain 8 to 1.2 GPM of ethane and heavier hydrocarbons. Such unconventionally-produced natural gas streams are generally supplied at relatively lower pressures, typically about 400 to 600 psig.

Thus, although various conventional systems and methods are known to separate ethane, propane, and heavier hydrocarbons from various natural gas (e.g., feed gas) streams, there is a need for improved systems and methods for processing a low pressure rich feed gas stream, for example, for recovering propane and heavier hydrocarbons and, optionally, for recovering ethane.

SUMMARY OF THE INVENTION

The subject matter disclosed herein is generally directed to systems and methods for the separation, for example, for the recovery of propane and heavier hydrocarbons and, optionally, ethane, from a low pressure rich gas stream.

An embodiment which is disclosed herein is a method for operating a natural gas liquids (NGL) recovery system, the method comprising separating a propane and heavier hydrocarbon stream from a feed stream comprising methane, ethane, and propane to yield an ethane-containing residue gas stream, wherein separating the propane and heavier hydrocarbons from the feed stream comprises cooling the feed stream to yield a chilled feed stream, introducing the chilled feed stream into a feed stream separation unit to yield a feed stream separator bottom stream and a feed stream separator overhead stream, compressing the feed stream separator bottom stream to yield a compressed feed stream separator bottom stream, introducing the compressed feed stream separator bottom stream into a stripper column, reducing the pressure of the feed stream separator overhead stream to yield a letdown feed stream separator overhead stream, introducing the letdown feed stream separator overhead stream into an absorber column, collecting a stripper column overhead stream from the stripper column, chilling the stripper column overhead stream to yield a chilled stripper column overhead stream, reducing the pressure of the chilled stripper column overhead stream to yield a letdown stripper column overhead stream, introducing the letdown stripper column overhead stream into the absorber column, collecting an absorber bottom stream from the absorber column, pumping the absorber bottom stream to yield a pressurized absorber bottom stream, heating the absorber bottom stream to yield a heated absorber bottom stream, introducing the heated absorber bottom stream into the stripper column, and collecting a stripper column bottom stream from the stripper column, wherein the stripper column bottom stream forms the propane and heavier hydrocarbon stream and wherein the propane and heavier hydrocarbon stream comprises propane and heavier hydrocarbons and less than about 2.0% of ethane by volume.

Another embodiment which is also disclosed herein is a natural gas liquids (NGL) recovery system comprising a deep dewpointing subsystem (DDS) configured to separate a propane and heavier hydrocarbon stream from a feed stream comprising methane, ethane, propane and heavier hydrocarbons to yield an ethane-containing residue gas stream, the DDS comprising a first heat exchanger configured to receive a feed stream and to output a chilled feed stream, a feed stream separation unit configured to receive the chilled feed stream and to output a feed stream separator bottom stream and a feed stream separator overhead stream, a first pump configured to pump the feed stream separator bottom stream and to output a pressurized feed stream separator bottom stream, a second heat exchanger configured to chill the pressurized feed stream separator bottom stream to yield a chilled feed stream separator bottom stream, a first valve configured to reduce the pressure of the feed stream separator overhead stream to yield a letdown feed stream separator overhead stream, an absorber column configured to receive the letdown feed stream separator overhead stream into an absorber column and to produce an absorber bottom stream, a second pump configured to receive the absorber bottom stream to output a pressurized absorber bottom stream, a stripper column configured to receive the chilled feed stream separator bottom stream and the pressurized absorber bottom stream and to output a stripper column overhead stream and a stripper column bottom stream, a third heat exchanger configured to chill the stripper column overhead stream and to heat the pressurized absorber bottom stream and to output a first chilled stripper column overhead stream and a heated absorber bottom stream, a fourth heat exchanger configured to further chill the first chilled stripper column overhead stream and to output a second chilled stripper column overhead stream, wherein the first heat exchanger is configured to further chill the second chilled stripper column overhead stream and to output a third chilled stripper column overhead stream, a second valve configured to reduce the pressure of the third chilled stripper column overhead stream to yield a depressurized stripper column overhead stream, wherein the absorber column is further configured to receive the depressurized stripper column overhead stream, and wherein the stripper column bottom stream forms the propane and heavier hydrocarbon stream and wherein the propane and heavier hydrocarbon stream comprises propane and heavier hydrocarbons and less than about 2.0% of ethane by volume.

Various objects, features, aspects and advantages of the present invention will become apparent from the following detailed description of preferred embodiments of the invention, along with the accompanying drawings.

DETAILED DESCRIPTION

This disclosure is generally directed to natural gas liquids recovery (NGL) processing systems and methods for the separation of natural gas, for example, for the recovery of propane and heavier hydrocarbons and, optionally, ethane, from a low pressure rich gas stream. In one or more of the embodiments disclosed herein, operation of the disclosed devices and methods allows for recovery of from about 80 to 90 vol. % of the ethane and from about 95 to about 99 vol. % of the propane within a feed gas stream.

Figure 1:
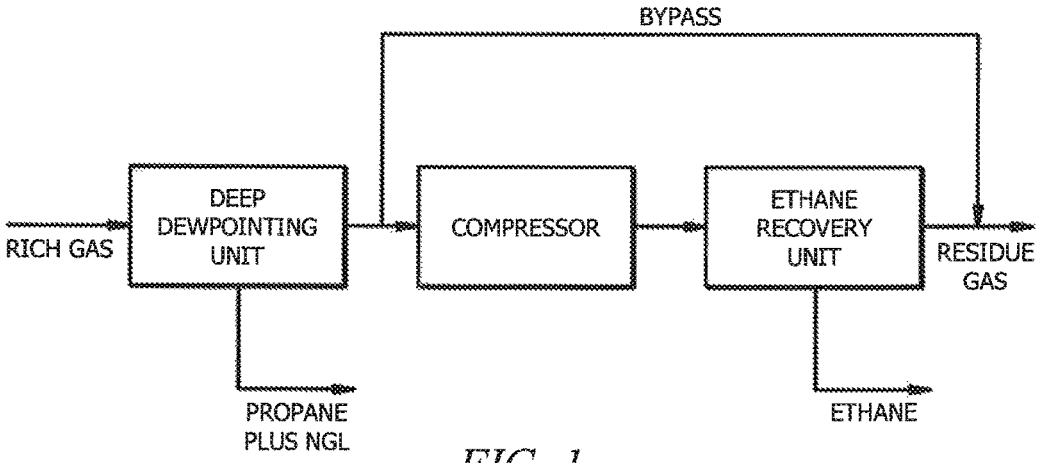
FIG. 1 is a block flow diagram of an embodiment of a NGL recovery system for ethane recovery and propane recovery according to the disclosed subject matter.

Referring to FIG. 1, a block flow diagram is shown schematically illustrating an embodiment of the disclosed NGL recovery systems and methods. In an embodiment, the NGL systems include and the NGL methods utilize a Deep Dewpointing subsystem (DDS). The DDS recovers almost all (e.g., at least 95 vol. %, alternatively, at least 96%, alternatively, at least 97%, alternatively, at least 98%) of the propane from the feed gas stream, thereby producing a propane and heavier hydrocarbons NGL stream and a residue gas stream (e.g., an ethane-containing residue gas). The residue gas stream is compressed and fed into an ethane recovery subsystem (ERS). The ERS uses a residue gas recycle for refluxing to achieve 90 vol. % plus ethane recovery. In an embodiment, the proportion of ethane recovered can be varied, accomplished by operating the ethane recovery plant at turndown, which significantly reduces the energy consumption of the gas plant. In an embodiment as will be disclosed herein, the disclosed NGL recovery systems (e.g., plants) and methods are particularly applicable for processing a rich feed gas (e.g., a feed gas having 8 to 10 GPM ethane and heavier hydrocarbons) and at low pressure (e.g., 400 to 600 psig). Additionally, in an embodiment, the disclosed NGL recovery systems and methods can be used for propane recovery, without the need to operate on ethane recovery, and can also be used for variable ethane production when lower ethane recovery is required. The bypass line as shown FIG. 1 can be varied as needed to meet the ethane recovery targets.

In an embodiment as will be disclosed herein, the DDS generally comprises a vapor-liquid separator, a first column (e.g., an absorber), and a second column (e.g., a stripper). More particularly, in an embodiment, the DDS comprises a two-column configuration, having an absorber and a stripper, wherein the absorber is configured to receive a flashed vapor from a separator and a chilled overhead stream from the stripper. In operation, the chilled stripper overhead is fed, as a reflux stream, to the absorber.

Also, in an embodiment of the DDS, a low pressure rich feed gas (typically 400 psig to 600 psig) is chilled by residue gas and propane refrigeration, for example, thereby producing a flashed vapor that is letdown in pressure to the absorber and a flashed liquid to the stripper. For example, in an embodiment, the absorber and the stripper are coupled to each other such that an expansion device (typically a JT valve) reduces the pressure of a stream to provide a flashed vapor to the lower section of the absorber, for example, which produces a liquid product that is pumped to a higher pressure and fed to an upper section of the stripper. The stripper typically operates at a higher pressure than the absorber, and reboiled with heat to produce a propane and heavier hydrocarbon NGL product stream with less than 1 mole % ethane and an ethane-rich overhead vapor stream with 50 vol. % or higher ethane content that is chilled with propane refrigeration and absorber overhead, and letdown in pressure as reflux to the absorber. The vapor product of the stripper is then cooled in an overhead exchanger, for example, using propane refrigeration and the refrigeration content of the overhead product of the absorber. Also disclosed herein is a high-propane-recovery process for processing a rich low pressure feed gas, using particularly configured heat exchangers and column configurations utilizing the stripper overhead vapor as reflux to the absorber. In one or more of the disclosed configurations and methods, the fractionation system (e.g., the DDS) is operated such that propane recovery from the feed gas stream is between 95 and 99 vol. %, and recovery of the C4 (e.g., butane) and heavier components from the feed gas stream is at least 99.9 vol. %.

Also in an embodiment as will be disclosed herein, in operation, the ERS uses a chilled recycle residue gas and a compressed feed gas (e.g., the ethane-containing residue gas from the DDS) as reflux to a demethanizer. Refrigeration may be supplied by a turbo-expander and propane refrigeration.

Figure 2:
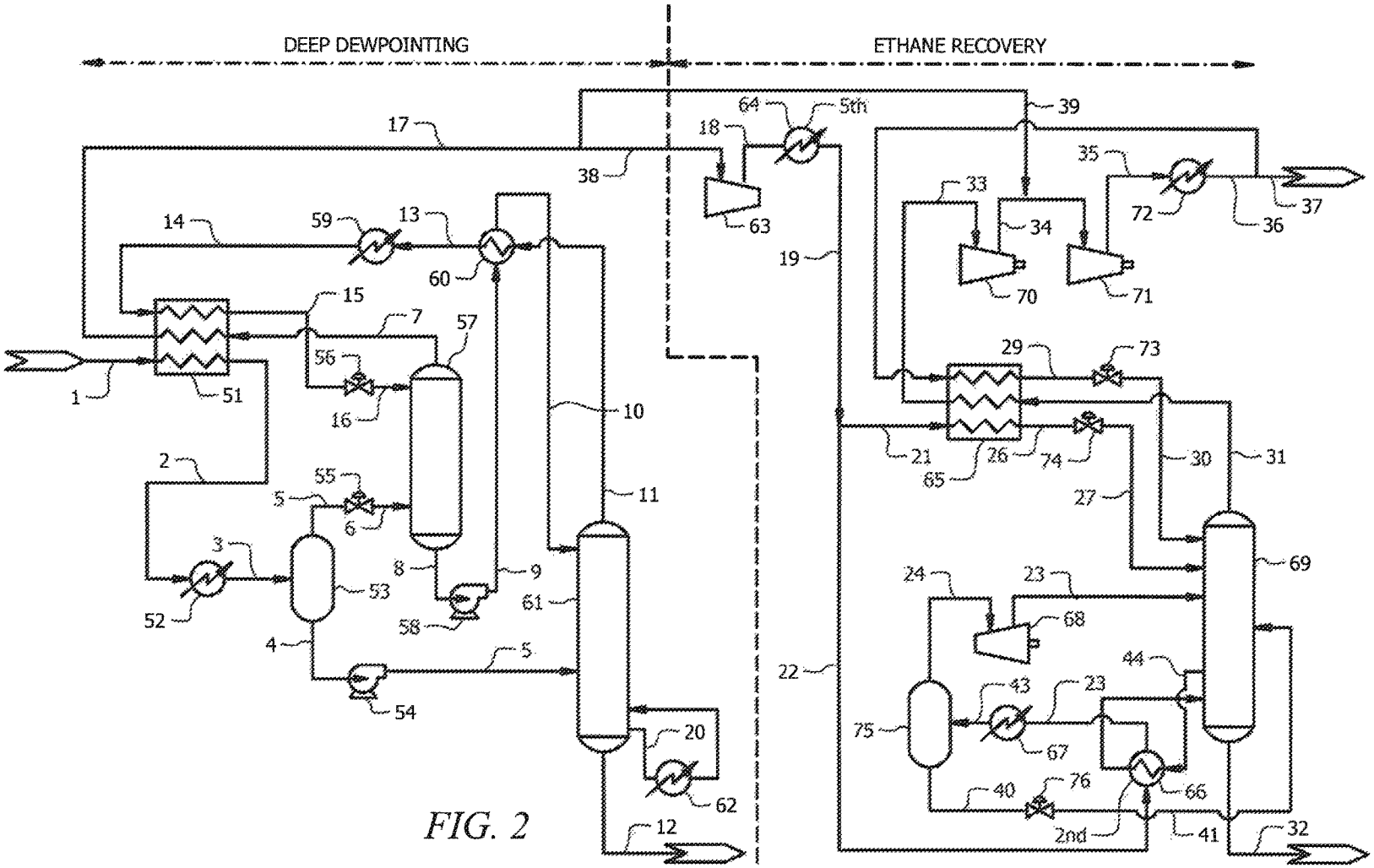
FIG. 2 shows an embodiment of a NGL recovery system for ethane recovery and propane recovery according to the disclosed subject matter.

Referring to FIG. 2, an embodiment of the NGL recovery system is illustrated. The following describes an example of a process for the propane recovery and, optionally, ethane recovery. In the embodiment of FIG. 2, a feed gas stream 1 is introduced into the NGL system (e.g., plant.) Prior to the NGL system, the untreated gas stream generally comprises the produced (e.g., "raw") gas to be processed; for example, the raw gas stream may comprise methane, ethane, propane, heavier hydrocarbons (e.g., C4, C5, C6, etc. hydrocarbons), nitrogen, carbon dioxide, and hydrogen sulfide and water. In an embodiment, the feed gas stream comprises a "rich" feed gas, for example, produced from an unconventional geological formation, and comprising about 50 to 70 mole % methane, 15 to 25 mole % ethane, with the remainder being propane, heavier hydrocarbons (e.g., butane, isobutane, pentane, isopentane, hexane, etc.) and/or trace amounts of various other fluids (nitrogen, carbon dioxide, and hydrogen sulfide).

In an embodiment, the feed gas stream has been pretreated so as to remove one or more undesirable components that may be present in the feed gas stream. In various embodiments, any pretreatment steps may be carried out in one, two or more distinct units and/or steps. In an embodiment, pretreatment of the feed gas stream 1 includes an acid gas removal unit to remove one or more acid gases such as hydrogen sulfide, carbon dioxide, and other sulfur contaminants such as mercaptans. For example, an acid gas removal unit may include an amine unit that employs a suitable alkylamine (e.g., diethanolamine, monoethanolamine, methyldiethanolamine, diisopropanolamine, or aminoethoxyethanol (diglycolamine)) to absorb any acid gases (e.g., hydrogen sulfide or carbon dioxide). In an embodiment, pretreatment of the feed gas stream 1 also includes removal of water in a dehydration unit, an example of which is a molecular sieve, for example, that is generally configured to contact a fluid with one or more desiccants (e.g., molecular sieves, activated carbon materials or silica gel). Another example of a dehydration unit is a glycol dehydration unit, which is generally configured to physically absorb water from the feed gas stream 1 using, for example, triethylene glycol, diethylene glycol, ethylene glycol, or tetraethylene glycol. In addition, the mercury contents in the feed gas stream 1 must be removed to a very low level to avoid mercury corrosion in a first heat exchanger 51.

The feed gas stream 1 pressure is typically from about 400 psig to about 600 psig. The feed gas stream 1 (e.g., dry, sweetened gas) is first cooled in the first heat exchanger 51. An example of such a suitable type and/or configuration of the first heat exchanger 51 is a plate and frame heat exchanger, for example, a brazed aluminum heat exchanger. The first heat exchanger 51 is generally configured to transfer heat between two or more fluid streams. In the embodiment of FIG. 2, the first heat exchanger 51 is configured to use a residue gas stream 7 (e.g., an methane and ethane-containing residue gas) to cool (e.g., chill) the feed gas stream 1 to about 10 to 30° F., thereby forming a chilled feed gas stream 2. Additionally, in the embodiment of FIG. 2, the chilled feed gas stream 2 is further cooled in second heat exchanger 52 via a refrigerant. In an embodiment, the refrigerant comprises a propane refrigerant that may further comprise, optionally, about 1 vol. % ethane and about 1 vol. % butane hydrocarbons. The chilled feed gas stream 2 may be further chilled to about −25 to −36° F., thereby forming a second chilled feed gas stream 3.

The second chilled feed gas stream 3 is introduced into a separator 53 (e.g., a vapor-liquid separator, such as a "flash" separator). In such an embodiment, the separator 53 may be operated at a temperature and/or pressure such that the second chilled feed gas stream 3 can be separated, for example, at least a portion of the chilled feed gas stream 3 to be "flash" evaporated, for example, thereby forming a "flash vapor" and a "flash liquid." The separator 53 may be operated at a temperature of from about −10° F. to −45° F. and pressure at about 10 to 20 psi lower than the feed supply pressure. Separation in the separator 53 produces a flashed vapor stream 5 and a flashed liquid stream 4. The flash vapor portion comprises, alternatively, consists of, mostly the lighter components, especially methane and ethane components, and the flash liquid portion comprises, alternatively, consists of, mostly the heavier components especially ethane, propane and butane and heavier components, and as such, the actual compositions also vary with the feed gas composition, and operating pressure and temperature.

The flashed vapor stream 5 is passed through a first valve 55, for example, which is configured as a JT valve or throttling valve, thereby causing a reduction (a "letdown") in the pressure of the flashed vapor stream 5, and thereby yielding a letdown flashed vapor stream 6. For example, the letdown flashed vapor stream 6 may have a pressure that is about 25 to 50 psi less than the pressure of the feed stream, depending on the feed supply pressure and the optimum absorber pressure.

The letdown flashed vapor stream 6 is fed to the bottom section of a first separation column (an absorber 57). The absorber 57 may be generally configured to allow one or more components present within the ascending vapor stream to be absorbed within a liquid stream. In such an embodiment, the absorber 57 may be configured as a packed column, bayed column or another suitable device. The absorber 57 may be operated such that an overhead temperature is from about −75° F. to about −45° F., alternatively, from about −70° F. to about −50° F., alternatively, from about −65° F. to about −55° F., a bottom temperature is from about −60° F. to about −10° F., alternatively, from about −65° F. to about −15° F., alternatively, from about −60° F. to about −20° F., and at a pressure of from about 400 psig to about 600 psig, alternatively, from about 450 psig to about 550 psig. The absorber 57 produces a residue stream 7 (for example, a propane depleted vapor stream) and a bottom liquid stream 8 (e.g., an ethane-enriched stream).

The absorber bottom liquid stream 8 from the absorber 57 is pressurized by pump 58 to yield a pressurized absorber bottom stream 9, which may have a pressure of about 500 psig or at least 50 psi higher than the stripper column. The pressurized absorber bottom stream 9 is heated in a third heat exchanger 60, for example, via heat exchange with a stripper overhead stream 11, to about −30° F., thereby forming a heated absorber bottom stream 10. In an alternative embodiment, the pressurized absorber bottom stream 9 can be heated via heat exchange with the chilled feed gas stream 2, such that the temperature of heated absorber bottom stream 10 is maintained at −30° F. or higher. In another alternative, stream 9 can be fed directly to the stripping without further heating, and the extent of heating depends on the feed gas composition and the absorber operating conditions. In such an alternative embodiment, a carbon steel material may be used in the stripper 61 into which the heated absorber bottom stream 10 will be fed, as will be disclosed herein. Not intending to be bound by theory, lower temperatures would require the use of stainless steel, which is more expensive than carbon steel. The heated absorber bottom stream 10 is fed into the top of the second column (the stripper 61).

The flashed liquid stream 4 from the separator 53 is pressurized by pump 54 to about 500 psig, thereby forming a pressurized flashed liquid stream 5. The pressurized flashed liquid stream 5 is also fed to the stripper 61, for example, into an intermediate portion of the stripper 61. The stripper 61 may be generally configured as a tower (e.g., a plate or tray column), a packed column, a spray tower, a bubble column, or combinations thereof. In the embodiment of FIG. 2, the stripper 61 is a non-refluxed type stripper without an overhead condenser, reflux drum, or reflux pump system, for example, as may be present in many conventional fractionation columns. The stripper 61 may be operated at an overhead temperature from about 20° F. to −20° F., a bottom temperature of 150° F. to 300° F., and at a pressure of about 470 psig to 600 psig. Also, in an embodiment, the stripper 61 is operated at a pressure that is about 20 to 150 psi higher than the pressure of the absorber 57. In the embodiment of FIG. 2, a stripper bottom stream 20 is removed (e.g., as a liquid) and directed to a first reboiler heat exchanger 62. In various embodiments, the first reboiler heat exchanger 62 may be heated, for example, thereby supplying heat to the stripper 61, via waste heat (e.g., from a residue gas compressor discharge) or via external heat such as hot oil or low pressure steam. After being heated in the first reboiler heat exchanger 62, the stripper bottom stream 20 is reintroduced into the stripper 61 (e.g., into a lower portion of the stripper 61).

The stripper is generally configured to fractionate the pressurized flashed liquid stream 5 from the separator 53 and the heated absorber bottom stream 10 to produce a NGL product stream 12 and a stripper overhead stream 11. In an embodiment, the NGL product stream 12 generally comprises propane and heavier hydrocarbons. For example, in an embodiment, the NGL product stream 12 comprises about 1.5 vol. % ethane, alternatively, less than about 2.0 vol. % ethane, alternatively, less than about 1.5 vol. % ethane, alternatively, less than about 1.0 vol. % ethane. For example, the NGL product stream 12 may have a liquid composition characterized as meeting the deethanized NGL specifications for propane product sales. In an embodiment, the NGL product stream 12 may also be characterized as comprising at least 95 vol. %, alternatively, at least 96%, alternatively, at least 97%, alternatively, at least 98% of the propane present within the feed gas stream 1. Also, in an embodiment, the NGL product stream 12 may also be characterized as comprising at least 97 vol. %, alternatively, at least 98%, alternatively, at least 99%, alternatively, at least 99.9% of the hydrocarbon components heavier than propane (e.g., C4 and heavier hydrocarbons) present within the feed gas stream 1.

The stripper overhead stream 11 is introduced into the third heat exchanger 60 where the stripper overhead stream 11 is cooled by the pressurized absorber bottom stream 9 to yield a first chilled stripper overhead stream 13. The first chilled stripper overhead stream 13 is introduced into a fourth heat exchanger 59 and is further chilled using propane, refrigeration, for example, to yield a second chilled stripper overhead stream 14. The second chilled stripper overhead stream 14 is introduced into the first heat exchanger 51 where it is further chilled via the residue gas stream 7 to yield a third chilled stripper overhead stream 15. For example, the third chilled stripper overhead stream 15 may have a temperature of from about −40° to −55° F. The third chilled stripper overhead stream 15 is passed through second valve 56, which may be configured as a JT valve, resulting in a decrease or let-down in the pressure of the third chilled stripper overhead stream 15, thereby yielding a lean (two phase stream) reflux stream 16. The lean reflux stream 16 is fed to the top of the absorber 57.

Also in the embodiment of FIG. 2, and as previously noted, the residue gas stream 7 is introduced into the first heat exchanger 51, for example, such that the refrigeration content of the residue gas stream 7 may be used to cool the feed gas stream 1 and the stripper overhead (e.g., the second chilled stripper overhead stream 14), while the residue gas stream 7 is heated to form a heated residue gas stream 17 (e.g., a heated ethane-containing residue gas). The heated residue gas stream 17 may have a temperature of about 70° F.

In an embodiment where it is not desired to recover ethane from the feed gas, more particularly, from the heated residue gas stream 17, (for example, recovery of only propane and heavier hydrocarbons is desired), the ERS, as will be disclosed herein, can be bypassed. For example, in the embodiment of FIG. 2, the heated residue gas stream 17 may be routed via a bypass line 39 to a second residue gas compressor 71 where the heated residue gas stream 17 (e.g., from bypass line 39) is compressed, thereby forming a compressed residue gas stream 35. The compressed residue gas stream 35 is cooled in a seventh heat exchanger 72 to form a cooled residue gas 36. The cooled residue gas 36 is delivered to the sales gas pipeline as a sales gas stream 37. Thus, in such an embodiment, the ERS and operation thereof is optional and is not required where it is not desired to recover ethane. Bypassing operation of the ERS can be considered as an "ethane rejection mode." In an embodiment where ethane recovery is not desired, only the DDS is required to be operated, for example, to recover the propane and heavier hydrocarbon components (e.g., almost all of the propane and heavier hydrocarbons, as disclosed herein), without the need of another unit operation, which greatly simplifies operation and reduces the capital when operating in an ethane rejection mode. Similarly, in an embodiment where relatively lower ethane (e.g., less than all of the available ethane) recovery is desired, a portion of the residue gas from the DDS can be bypassed by the ERS, which allows the ethane recovery unit to operate at a lesser throughput (e.g., at turndown), for example, which would advantageously reduce the power consumption attributable to the ERS.

Alternatively, in an embodiment where ethane recovery is required, the ERS may be operated to recover ethane from the residue gas stream from the DDS. Referring again to FIG. 2, the heated residue gas stream 17 from the DDS may be fed to the ERS. More particularly, the heated residue gas stream 17 is compressed by compressor 63 to form a compressed residue stream 18. The compressed residue stream 18 may have a pressure of at least about 800 psig, alternatively, from about 900 to 1200 psig. The compressed residue stream 18 is cooled in a fifth heat exchanger 64 to form a cooled residue stream 19. The cooled residue stream 19 may have a temperature of about 100° F. The cooled residue stream 19 may be split or divided into two portions: a first portion residue stream 21 and a second portion residue stream 22. In an embodiment, the first portion residue stream 21 may comprise about 20 to 50 vol. % of the cooled residue stream 19, and the second portion residue stream 22 may comprise about 60 to 80 vol. % of the cooled residue stream 19.

The first portion residue stream 21 is cooled and condensed in a seventh heat exchanger 65, forming a chilled first portion residue stream 26. The chilled first portion residue stream 26 is passed through a third valve 74 (e.g., a JT valve) forming a letdown first portion residue stream 27. The letdown first portion residue stream 27 is introduced into an upper portion of the demethanizer 69. Thus, the letdown first portion residue stream 27 may serve as reflux stream to the demethanizer 69.

The second portion residue stream 22 is introduced into a second reboiler heat exchanger 66 where the second portion residue stream 22 is cooled by heat exchange with a demethanizer bottom stream 44 to form a cooled second portion residue stream 23. The cooled second portion residue stream 23 may have a temperature of about −5° F. The cooled second portion residue stream 23 is introduced into a sixth heat exchanger 67 where the cooled second portion residue stream 23 is further chilled, for example, via refrigerant such as propane, to form a chilled second portion residue stream 43. The chilled second portion residue stream 43 may have a temperature of from about −25 to −38° F.

The chilled second portion residue stream 43 is introduced into separator 75, for example, a vapor-liquid separator. Separation in the separator 75 yields a separator overhead stream 24 (e.g., a flashed vapor stream) and a separator bottom stream 40 (e.g., a flashed liquid stream). The separator bottom stream 40 (e.g., flashed liquid stream) is passed through a fourth valve 76 (e.g., a JT valve), yielding a decrease (letdown) in pressure and forming a letdown separator bottom stream 41. The letdown separator bottom stream 41 is introduced into the demethanizer 69.

The separator overhead stream 24 (e.g., flashed vapor stream) is introduced into a turbo-expander 68 yielding a decrease (letdown) in pressure and forming a letdown separator stream 25. The letdown stream 25 may have a pressure of about 300 to 400 psig and a temperature of about −105° F. The letdown stream 25 is also introduced into an upper section of the demethanizer 69.

In an embodiment, the demethanizer 69 may generally be configured to allow one or more components present within the ascending vapor stream to be absorbed within a liquid stream, for example, the demethanizer 69 may be configured to operate as an absorber. In such an embodiment, the demethanizer 69 may be configured as a packed column or another suitable configuration. In operation, the demethanizer 69 produces a demethanizer bottom stream 32 (e.g., a liquid bottom stream). The demethanizer bottom stream 32 comprises ethane, for example, at least 95 vol. %, alternatively, at least 96%, alternatively, at least 97%; the ethane purity depends on the residual propane content in the residue gas from the DDP unit upstream. The demethanizer bottom stream 32 also comprises less than 0.5 vol. % methane, for example, such that the composition of the demethanizer bottom stream 32 meets the specifications for an ethane product (e.g., a substantially methane-free product). In various embodiments, the demethanizer bottom stream 32 (e.g., ethane liquid) can be pressurized, for example, to be sent to an ethane pipeline, or can be exported to an outside market.

The demethanizer 69 also produces a demethanizer overhead stream 31. The demethanizer overhead stream 31 may be characterized as substantially ethane free, for example, having less than 5 vol. % ethane, alternatively, less than 4%, alternatively, less than 3%, alternatively, less than 2%. The demethanizer overhead stream 31 is introduced into the exchanger 65, for example, where the demethanizer overhead stream 31 is used to cool to the first portion feed stream 21 and a residue gas return stream 28, thereby forming a heated demethanizer overhead stream 33. The heated demethanizer overhead stream 33 (e.g., a heated, substantially ethane-free residue gas stream) is fed to a first residue gas compressor 70 with power supplied by turboexpander 68 (e.g., a compander configuration), to form a first compressed demethanizer overhead stream 34 (e.g., a substantially ethane-free residue gas stream). The first compressed demethanizer overhead stream 34 is fed to a second residue gas compressor 71 where the first compressed demethanizer overhead stream 34 is compressed to form a compressed residue gas stream 35 (e.g., a compressed, substantially ethane-free residue gas stream). The compressed residue gas stream 35 is fed to the seventh heat exchanger 72 where the compressed residue gas stream 35 is cooled to form a cooled residue gas. The cooled residue gas 36 is delivered to the sales gas pipeline as a sales gas stream 37.

In an embodiment, at least a portion of the residue gas (e.g., from the cooled residue gas 36) may be returned to the demethanizer 69, for example, as a reflux stream. For example, in the embodiment of FIG. 2, a portion of the cooled residue gas 36 is separated from the rest of the residue stream (e.g., the cooled residue gas 36) as the residue gas return stream 28. The residue gas return stream 28 may comprise from about 15 to about 25 vol. % of the total residue gas (e.g., the cooled residue gas 36), which will be supplied to the demethanizer as a top reflux. The residue gas return stream 28 is cooled and condensed in the heat exchanger 65 to form a cooled residue gas return stream 29. The cooled residue gas return stream 29 may have a temperature of about −120° F. The cooled residue gas return stream 29 is passed through a fifth valve 73 (e.g., a JT valve), thereby yielding a decrease (a letdown) in the pressure of the residue gas return stream 29 and, providing a methane rich reflux to the demethanizer, for example, to enhance ethane recovery. Thus, the heat exchanger 65 uses the refrigeration content in a residue gas stream from the demethanizer 69, as disclosed herein, to cool a portion of the feed gas from the DDS and a residue return gas stream (e.g., a recycle gas) to produce cold, lean refluxes to the demethanizer. The chill cooling may be supplemented by refrigeration produced from a turbo-expander and/or a propane refrigeration unit, as disclosed herein.

In an embodiment, the disclosed configuration of the ERS can recover at least about 90 vol. %, alternatively, at least about 91%, alternatively, at least about 92%, alternatively, at least about 93%, alternatively, at least about 94 alternatively, about 95% of the ethane originally present in the feed gas (e.g., the feed gas stream 1).

Conventional NGL recovery processes require the use of refrigeration and turbo-expansion. When high NGL recoveries are required, the NGL technology may include multi-component refrigeration (methane, ethane, and propane) or a turbo-expander cryogenic process with high expansion ratio to produce cryogenic temperatures. Such cryogenic processes may require one or more separators to recover the NGL components, and expanded gas is fed to a demethanizer column to produce a residue gas and a Y-Grade NGL product (e.g., containing the ethane plus components). When ethane product is required, a deethanizer unit must be used to separate ethane from the propane plus hydrocarbons.

Alternatively, when ethane is not desirable, the plant must operate in "ethane rejection mode" in which ethane from the deethanizer unit is re-injected to the residue gas.

Figure 3:
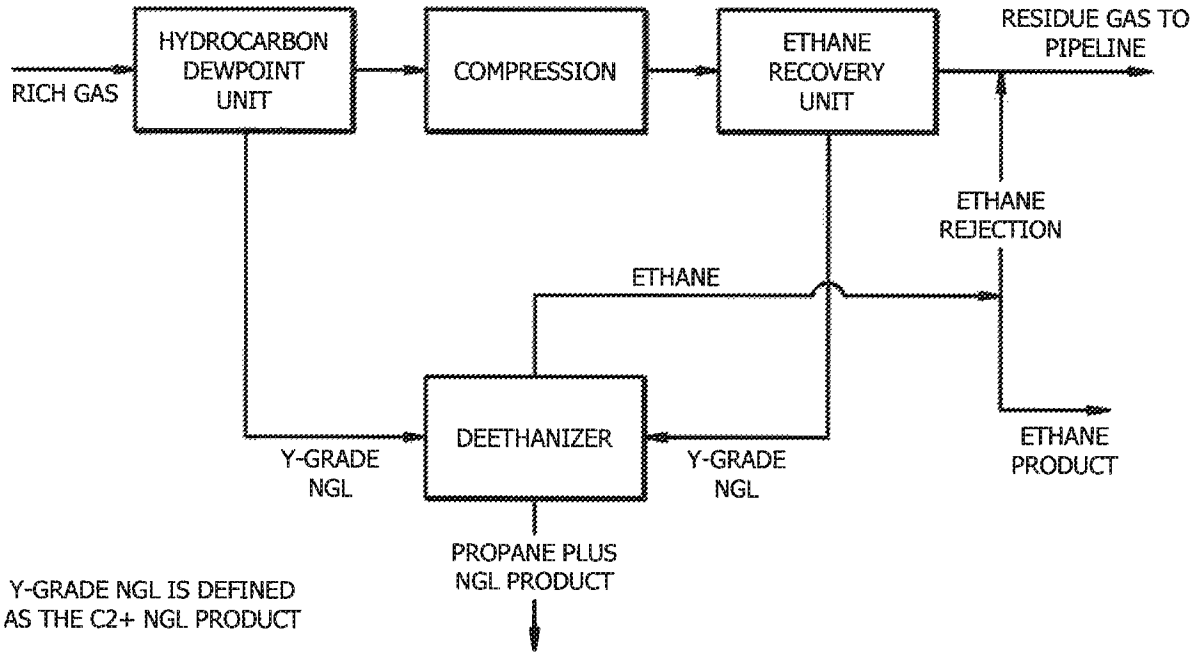
FIG. 3 is a block flow diagram of a conventional plant for ethane recovery and ethane rejection.

Conventionally, when processing a rich feed gas, the heavy hydrocarbons content must be removed using a hydrocarbon dewpointing unit before the gas is compressed to a higher pressure feeding the NGL recovery plant. The dewpointing unit produces a Y-grade NGL, typically recovering 40 to 60% of the propane content. A block flow diagram of such a conventional design is shown in FIG. 3. In other known processes, the ethane recovery and ethane rejection can be incorporated in a single design. Such processes can operate in either an ethane recovery or an ethane rejection mode, producing a Y-Grade NGL. In these designs, the vapor-liquid streams, resulting from the turbo-expansion process, are fed to a dual column which acts as a demethanizer or deethanizer depending on the ethane recovery or rejection operation. While conceptually relatively simple, these processes still require substantial process control and dedicated equipment.

The disclosed systems and methods overcome various difficulties associated with conventional plants that typically require a deethanizer for ethane rejection, thereby significantly increasing the capital investment. The systems and methods disclosed herein can be used for propane recovery and, optionally, ethane recovery, more particularly, for high ethane recovery of over 90% and with the capability of ethane rejection without the additional investment of a deethanizer.

EXAMPLES

The following examples illustrate the operation of an NGL recovery system, such as the NGL recovery system disclosed previously. Particularly, the following examples illustrate the operation of a NGL recovery system as disclosed with respect to FIG. 2. Table 1 illustrates the ethane present of various streams (in mole percent) and other data corresponding to the stream disclosed with respect to FIG. 2; Table 2 illustrates the propane present of various streams (in mole percent) and other data corresponding to the stream disclosed with respect to FIG. 2; and Table 3 illustrates the ethane and propane recovery from various of the disclosed processes.

TABLE 1

Ethane Recovery:

| | Stream Description | | | | | |
|---|---|---|---|---|---|---|
| | Feed Gas | Residue Gas from DDP - C3 Recovery Unit | C3 + NGL from DDP - C3 Recovery Unit | Residue Gas from ERGR - C2 Recovery Unit | Ethane Liquid Product | Residue Gas to Sales Gas Pipeline |
| | Stream No. | | | | | |
| | 1 | 2 | 3 | 4 | 5 | 6 |
| Pressure [psia] | 472 | 410 | 1,415 | 417 | 1,205 | 1,130 |
| Temperature [F.] | 80 | 73 | 134 | 78 | 51 | 120 |
| Molar Flow [lbmole/hr] | 8,524 | 7,359 | 1,156 | 7,051 | 1,718 | 5,641 |
| Mass Flow [lb/hr] | 203,236 | 147,430 | 55,507 | 119,501 | 51,829 | 95,601 |
| Std Gas Flow [MMSCFD] | 77.6 | 67.0 | 10.5 | 64.2 | 15.6 | 51.4 |
| Liq Vol Flow @Std Cond [barrel/day] | | | 7,155.3 | | 9,879.6 | |
| Molecular Weight | 23.84 | 20.03 | 48.01 | 16.95 | 30.16 | 16.95 |
| HHV, Btu/SCF | 1,389 | 1,181 | 2,709 | 1,003 | 1,763 | 1,003 |
| Mole % | | | | | | |
| Carbon Dioxide | 0.0001 | 0.0001 | 0.0000 | 0.0001 | 0.0002 | 0.0001 |
| Nitrogen | 1.9154 | 2.2185 | 0.0000 | 2.8942 | 0.0000 | 2.8942 |
| Methane | 61.6696 | 71.4125 | 0.0000 | 93.1266 | 0.1251 | 93.1266 |
| Ethane | 22.8596 | 26.1808 | 1.6165 | 3.9759 | 99.0792 | 3.9759 |
| Propane | 10.1338 | 0.1866 | 73.1817 | 0.0031 | 0.7893 | 0.0031 |
| i-Butane | 0.8141 | 0.0008 | 5.9911 | 0.0000 | 0.0034 | 0.0000 |
| n-Butane | 2.1085 | 0.0007 | 15.5334 | 0.0000 | 0.0029 | 0.0000 |
| i-Pentane | 0.1929 | 0.0000 | 1.4217 | 0.0000 | 0.0000 | 0.0000 |
| n-Pentane | 0.2394 | 0.0000 | 1.7651 | 0.0000 | 0.0000 | 0.0000 |
| Hexane | 0.0522 | 0.0000 | 0.3849 | 0.0000 | 0.0000 | 0.0000 |
| Heptane | 0.0126 | 0.0000 | 0.0925 | 0.0000 | 0.0000 | 0.0000 |
| Octane | 0.0018 | 0.0000 | 0.0130 | 0.0000 | 0.0000 | 0.0000 |

TABLE 2

Propane Recovery:

| | Stream Description | | | | | |
|---|---|---|---|---|---|---|
| | Feed Gas | Residue Gas from DDP - C3 Recovery Unit | C3 + NGL from DDP - C3 Recovery Unit | Residue Gas from ERGR - C2 Recovery Unit | Ethane Liquid Product | Residue Gas to Sales Gas Pipeline |
| | Stream No. | | | | | |
| | 1 | 2 | 3 | 4 | 5 | 6 |
| Pressure [psia] | 472 | 410 | 1,415 | | | 1,130 |
| Temperature [F.] | 80 | 73 | 134 | | | 120 |

TABLE 2-continued

| Propane Recovery: | | | | | | |
|---|---|---|---|---|---|---|
| | Stream Description | | | | | |
| | Feed Gas | Residue Gas from DDP - C3 Recovery Unit | C3 + NGL from DDP - C3 Recovery Unit | Residue Gas from ERGR - C2 Recovery Unit | Ethane Liquid Product | Residue Gas to Sales Gas Pipeline |
| | Stream No. | | | | | |
| | 1 | 2 | 3 | 4 | 5 | 6 |
| Molar Flow [lbmole/hr] | 8,524 | 7,359 | 1,156 | Not Applicable | Not Applicable | 7,359 |
| Mass Flow [lb/hr] | 203,236 | 147,420 | 55,506 | | | 147,420 |
| Std Gas Flow [MMSCFD] | 77.6 | 67.0 | 10.5 | | | 67.0 |
| Liq Vol Flow @Std Cond [barrel/day] | | | 7,155.2 | | | |
| Molecular Weight | 23.84 | 20.03 | 48.01 | | | 20.03 |
| HHV, Btu/SCF | 1,389 | 1,181 | 2,709 | | | 1,181 |
| Mole % | | | | | | |
| Carbon Dioxide | 0.0001 | 0.0001 | 0.0000 | | | 0.0001 |
| Nitrogen | 1.9154 | 2.2186 | 0.0000 | | | 2.2186 |
| Methane | 61.6696 | 71.4123 | 0.0000 | | | 71.4123 |
| Ethane | 22.8596 | 26.1809 | 1.6139 | | | 26.1809 |
| Propane | 10.1338 | 0.1866 | 73.1839 | | | 0.1866 |
| i-Butane | 0.8141 | 0.0008 | 5.9912 | | | 0.0008 |
| n-Butane | 2.1085 | 0.0007 | 15.5337 | | | 0.0007 |
| i-Pentane | 0.1929 | 0.0000 | 1.4218 | | | 0.0000 |
| n-Pentane | 0.2394 | 0.0000 | 1.7652 | | | 0.0000 |
| Hexane | 0.0522 | 0.0000 | 0.3849 | | | 0.0000 |
| Heptane | 0.0126 | 0.0000 | 0.0925 | | | 0.0000 |
| Octane | 0.0018 | 0.0000 | 0.0130 | | | 0.0000 |

TABLE 3

| Recovery Performance: | | |
|---|---|---|
| Operation | Propane Recovery | Ethane Recovery |
| Ethane Recovery | 1.1% | 92.5% |
| Propane Recovery | 98.4% | 100.0% |
| C3 + NGL, BPD | 7,155 | 7,155 |
| C2 Product, BPD | — | 10,331 |
| Inlet Compression, HP | Not Required | 4,436 |
| Residue Gas Compression, HP | 4,171 | 4,123 |
| Total HP | 4,171 | 8,559 |
| Refrigeration Duty, MM Btu/h | 32.2 | 39.0 |
| Heat Duty, MM Btu/h | 24.0 | 23.0 |

Additional Embodiments

A first embodiment, which is a method for operating a natural gas liquids (NGL) recovery system, the method comprising separating a propane and heavier hydrocarbon stream from a feed stream comprising methane, ethane, and propane to yield an ethane-containing residue gas stream, wherein separating the propane and heavier hydrocarbons from the feed stream comprises cooling the feed stream to yield a chilled feed stream, introducing the chilled feed stream into a feed stream separation unit to yield a feed stream separator bottom stream and a feed stream separator overhead stream, pressurizing the feed stream separator bottom stream to yield a feed stream separator bottom stream, introducing the feed stream separator bottom stream into a stripper column, reducing the pressure of the feed stream separator overhead stream to yield a letdown feed stream separator overhead stream, introducing the letdown feed stream separator overhead stream into an absorber column, collecting a stripper column overhead stream from the stripper column, chilling the stripper column overhead stream to yield a chilled stripper column overhead stream, reducing the pressure of the Chilled stripper column overhead stream to yield a letdown stripper column overhead stream, introducing the letdown stripper column overhead stream into the absorber column, collecting an absorber bottom stream from the absorber column, pumping the absorber bottom stream to yield a absorber bottom stream, heating the absorber bottom stream to yield a heated absorber bottom stream, introducing the heated absorber bottom stream into the stripper column, and collecting a stripper column bottom stream from the stripper column, wherein the stripper column bottom stream forms the propane and heavier hydrocarbon stream and wherein the propane and heavier hydrocarbon stream comprises propane and heavier hydrocarbons and less than about 2.0% of ethane by volume.

A second embodiment, which is the method of the first embodiment, wherein cooling the feed stream comprises introducing the feed stream into a first heat exchanger and a second heat exchanger.

A third embodiment, which is the method of one of the first through the second embodiments, wherein heating the absorber bottom stream comprises introducing the absorber bottom stream into a third heat exchanger.

A fourth embodiment, which is the method of the third embodiment, wherein chilling the stripper column overhead stream comprises introducing the stripper column overhead stream into the third heat exchanger, a fourth heat exchanger, and the first heat exchanger.

A fifth embodiment, which is the method of one of the first through the fourth embodiments, wherein reducing the pressure of the separator overhead stream comprises passing the separator overhead stream through a first valve.

A sixth embodiment, which is the method of one of the first through the fifth embodiments, wherein reducing the pressure of the chilled stripper column overhead stream comprises passing the chilled stripper column through a second valve.

A seventh embodiment, which is the method of one of the first through the sixth embodiments, wherein separating the propane and heavier hydrocarbons from the feed stream further comprises collecting an absorber overhead stream from the absorber, wherein the absorber overhead stream forms the ethane-containing residue gas stream.

An eighth embodiment, which is the method of the seventh embodiment, further comprising compressing the absorber overhead stream to yield a compressed absorber overhead stream and chilling the compressed absorber overhead stream to yield a chilled absorber overhead stream.

A ninth embodiment, which is the method of the eighth embodiment, wherein chilling the compressed absorber overhead stream comprises introducing the compressed absorber overhead stream into a fifth heat exchanger.

A tenth embodiment, which is the method of one of the eighth through the ninth embodiments, further comprising separating ethane from the ethane-containing residue gas stream, wherein separating ethane from the ethane-containing residue gas stream comprises cooling a first portion of the ethane-containing residue gas stream to yield a cooled first portion residue gas stream, reducing the pressure of the cooled first portion residue gas stream to yield a letdown first portion residue gas stream, introducing the letdown first portion residue gas stream into a demethanizer column, cooling a second portion of the ethane-containing residue gas stream to yield a cooled second portion residue gas stream, introducing the cooled second portion residue gas stream into a residue gas separation unit to yield a residue gas separator bottom stream and a residue gas separator overhead stream, reducing the pressure of the residue gas separator bottom stream to yield a letdown residue gas separator bottom stream, introducing the letdown residue gas separator bottom stream into a lower portion of the demethanizer column, decreasing the pressure of the residue gas separator overhead stream to yield a letdown residue gas separator overhead stream, introducing the letdown residue gas separator overhead stream into an upper portion of the demethanizer column, and collecting a demethanizer column bottom stream, wherein the demethanizer column bottom stream comprises at least 98% ethane by volume.

An eleventh embodiment, which is the method of the tenth embodiment, wherein cooling the first portion of the ethane-containing residue gas stream comprises introducing the first portion of the ethane-containing residue gas stream into a sixth heat exchanger.

A twelfth embodiment, which is the method of one of the tenth through the eleventh embodiments, wherein cooling the second portion of the ethane-containing residue gas stream comprises introducing the second portion of the ethane-containing residue gas stream into a demethanizer reboiler heat exchanger.

A thirteenth embodiment, which is the method of one of the tenth through the twelfth embodiments, wherein reducing the pressure of the cooled first portion residue gas stream comprises introducing the cooled first portion residue gas stream into a third valve.

A fourteenth embodiment, which is the method of one of the tenth through the thirteenth embodiments, further comprising collecting a demethanizer column overhead stream, wherein the demethanizer column overhead stream comprises a substantially ethane-free residue gas stream and returning a portion of the substantially ethane-free residue gas stream to the demethanizer column.

A fifteenth embodiment, which is the method of one of the first through the fourteenth embodiments, wherein the propane and heavier hydrocarbon stream comprises at least about 95 vol. % of the propane present within the feed stream.

A sixteenth embodiment, which is the method of one of the first through the fifteenth embodiments, wherein the propane and heavier hydrocarbon stream comprises at least about 99 vol. % of the C4 and heavier hydrocarbons present within the feed stream.

A seventeenth embodiment, which is a natural gas liquids (NGL) recovery system comprising a deep dewpointing subsystem (DDS) configured to separate a propane and heavier hydrocarbon stream from a feed stream comprising methane, ethane, and propane to yield an ethane-containing residue gas stream, the DDS comprising a first heat exchanger configured to receive a feed stream and to output a chilled feed stream, a feed stream separation unit configured to receive the chilled feed stream and to output a feed stream separator bottom stream and a feed stream separator overhead stream, a first compressor configured to compress the feed stream separator bottom stream and to output a compressed feed stream separator bottom stream, a second heat exchanger configured to chill the compressed feed stream separator bottom stream to yield a chilled feed stream separator bottom stream, a first valve configured to reduce the pressure of the feed stream separator overhead stream to yield a letdown feed stream separator overhead stream, an absorber column configured to receive the letdown feed stream separator overhead stream into an absorber column and to produce an absorber bottom stream, a second compressor configured to receive the absorber bottom stream to output a compressed absorber bottom stream, a stripper column configured to receive the chilled feed stream separator bottom stream and the compressed absorber bottom stream and to output a stripper column overhead stream and a stripper column bottom stream, a third heat exchanger configured to chill the stripper column overhead stream and to heat the compressed absorber bottom stream and to output a first chilled stripper column overhead stream and a heated absorber bottom stream, a fourth heat exchanger configured to further chill the first chilled stripper column overhead stream and to output a second chilled stripper column overhead stream, wherein the first heat exchanger is configured to further chill the second chilled stripper column overhead stream and to output a third chilled stripper column overhead stream, a second valve configured to reduce the pressure of the third chilled stripper column overhead stream to yield a compressed stripper column overhead stream, wherein the absorber column is further configured to receive the compressed stripper column overhead stream, and wherein the stripper column bottom stream forms the propane and heavier hydrocarbon stream and wherein the propane and heavier hydrocarbon stream comprises propane and heavier hydrocarbons and less than about 2.0% of ethane by volume.

An eighteenth embodiment, which is the system of the seventeenth embodiment, wherein the absorber is further configured to output an absorber overhead stream, wherein the absorber overhead stream forms the ethane-containing residue gas stream.

A nineteenth embodiment, which is the system of the eighteenth embodiment, wherein the DDS further comprises a second compressor configured to receive the absorber overhead stream and to output a compressed absorber overhead stream and a first heat exchanger configured to chill the compressed absorber overhead stream and to output a chilled absorber overhead stream.

A twentieth embodiment, which is the system of the nineteenth embodiment, further comprising an ethane-recovery subsystem (ERS) configured to separate ethane from the ethane-containing residue gas stream, wherein the ERS comprises a sixth heat exchanger configured to cool a first portion of the ethane-containing residue gas stream and to output a cooled first portion residue gas stream, a third valve configured to reduce the pressure of the cooled first portion residue gas stream to output a letdown first portion residue gas stream, a demethanized column configured to receive the letdown first portion residue gas stream, a demethanizer reboiler heat exchanger configured to cool a second portion of the ethane-containing residue gas stream and to output a cooled second portion residue gas stream, a residue gas separation unit configured to receive the cooled second portion residue gas stream and to output a residue gas separator bottom stream and a residue gas separator overhead stream, a fourth valve configured to reduce the pressure of the residue gas separator bottom stream to output a letdown residue gas separator bottom stream, wherein the demethanizer column is further configured to receive the letdown residue gas separator bottom stream into a lower portion thereof, a turbo-expander configured to decrease the pressure of the residue gas separator overhead stream and to output a letdown residue gas separator overhead stream, wherein the demethanizer column is further configured to receive the letdown residue gas separator overhead stream into an upper portion thereof, and wherein the demethanizer column is further configured to output a demethanizer column bottom stream comprising at least 98% ethane by volume.

A twenty-first embodiment, which is the system of the twentieth embodiment, wherein the demethanizer column is further configured to output a demethanizer column overhead stream, wherein the demethanizer column overhead stream comprises a substantially ethane-free residue gas stream.

A twenty-second embodiment, which is the system of one of the seventeenth through the twenty-first embodiments, wherein the propane and heavier hydrocarbon stream comprises at least about 95 vol. % of the propane present within the feed stream.

A twenty-third embodiment, which is the system of one of the seventeenth through the twenty-second embodiments, wherein the propane and heavier hydrocarbon stream comprises at least about 99 vol. % of the C4 and heavier hydrocarbons present within the feed stream.

Thus, specific embodiments and applications for NGL recovery from low pressure feed gases have been disclosed. It should be apparent, however, to those skilled in the art that many more improvements besides those already described are possible without departing from the inventive concepts herein. The inventive subject matter, therefore, is not to be restricted except in the spirit of the present disclosure. Moreover, in interpreting the specification and contemplated claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Furthermore, where a definition or use of a term in a reference, which is incorporated by reference herein, is inconsistent or contrary to the definition of that term provided herein, the definition of that term provided herein applies and the definition of that term in the reference does not apply.

What is claimed is:

1. A method for operating a natural gas liquids (NGL) recovery system, the method comprising:

separating a feed stream comprising methane, ethane, and propane into a propane and heavier hydrocarbon stream and an ethane-containing residue gas stream, wherein separating the feed stream comprises:

cooling the feed stream to yield a chilled feed stream;

introducing the chilled feed stream into a feed stream separation unit to yield a feed stream separator bottom stream and a feed stream separator overhead stream;

pumping the feed stream separator bottom stream to yield a pressurized feed stream separator bottom stream;

introducing the pressurized feed stream separator bottom stream into a stripper column;

reducing the pressure of the feed stream separator overhead stream using a first JT valve to yield a letdown feed stream separator overhead stream;

introducing the letdown feed stream separator overhead stream into an absorber column;

collecting a stripper column overhead stream from the stripper column;

chilling the stripper column overhead stream to yield a first chilled stripper column overhead stream utilizing refrigerant content from an absorber bottom stream;

chilling the first chilled stripper column overhead stream utilizing propane refrigeration to yield a second chilled stripper column overhead stream;

chilling the second chilled stripper column overhead utilizing refrigerant content from an absorber overhead stream to yield a third chilled stripper column overhead stream;

reducing the pressure of the third chilled stripper column overhead stream using a second JT valve to yield a letdown stripper column overhead stream;

introducing the letdown stripper column overhead stream as a lean reflux to a top of the absorber column, wherein the lean reflux is a two phase stream;

collecting the absorber bottom stream from the absorber column;

pumping the absorber bottom stream to yield a pressurized absorber bottom stream;

heating the pressurized absorber bottom stream to yield a heated absorber bottom stream;

introducing the heated absorber bottom stream to a top of the stripper column;

supplying heat to the stripper column; and collecting a stripper column bottom stream from the stripper column, wherein the stripper column bottom stream forms the propane and heavier hydrocarbon stream and wherein the propane and heavier hydrocarbon stream comprises propane and heavier hydrocarbons and less than about 2.0% of ethane by volume.

2. The method of claim 1, wherein cooling the feed stream comprises introducing the feed stream into a first heat exchanger and a second heat exchanger.

3. The method of claim 2, wherein heating the pressurized absorber bottom stream comprises introducing the pressurized absorber bottom stream into a third heat exchanger.

4. The method of claim 3, wherein chilling the stripper column overhead stream comprises heat exchanging the stripper column overhead stream and the absorber bottom stream in the third heat exchanger, wherein chilling the first chilled stripper column overhead stream comprises heat exchanging the first chilled stripper column overhead stream and propane in a fourth heat exchanger, and wherein chilling the second chilled stripper column overhead stream comprises heat exchanging the second chilled stripper column overhead stream and the absorber overhead stream in the first heat exchanger.

5. The method of claim 2, wherein separating the feed stream further comprises:

collecting the absorber overhead stream from the absorber column, wherein the absorber overhead stream forms the ethane-containing residue gas stream.

6. The method of claim 5, further comprising:

heating the absorber overhead stream in the first heat exchanger to form a heated residue gas stream;

compressing the heated residue gas stream to yield a compressed residue gas stream; and cooling the compressed residue gas stream to yield a cooled residue gas stream.

7. The method of claim 6, wherein cooling the compressed residue gas stream comprises introducing the compressed residue gas stream into a fifth heat exchanger.

8. The method of claim 6, further comprising:

separating ethane from the cooled residue gas stream, wherein separating ethane from the cooled residue gas stream comprises:

splitting the cooled residue gas stream into a first portion and a second portion;

cooling the first portion of the cooled residue gas stream to yield a cooled first portion residue gas stream;

reducing the pressure of the first portion of the cooled residue gas stream to yield a letdown first portion residue gas stream;

introducing the letdown first portion residue gas stream into a demethanizer column as a demethanizer reflux stream;

cooling a second portion of the cooled residue gas stream to yield a cooled second portion residue gas stream;

introducing the cooled second portion residue gas stream into a residue gas separator to yield a residue gas separator bottom stream and a residue gas separator overhead stream;

reducing the pressure of the residue gas separator bottom stream to yield a letdown residue gas separator bottom stream;

introducing the letdown residue gas separator bottom stream into a mid-section of the demethanizer column;

reducing the pressure of the residue gas separator overhead stream to yield a letdown residue gas separator overhead stream;

introducing the letdown residue gas separator overhead stream into an upper portion of the demethanizer column;

collecting a demethanizer column bottom stream, wherein the demethanizer column bottom stream comprises at least 98% ethane by volume.

9. The method of claim 8, wherein cooling the first portion of the cooled residue gas stream comprises introducing the first portion of the cooled residue gas stream into a sixth heat exchanger.

10. The method of claim 8, wherein cooling the second portion of the cooled residue gas stream comprises introducing the second portion of the cooled residue gas stream into a demethanizer reboiler heat exchanger.

11. The method of claim 8, wherein reducing the pressure of the first portion of the cooled residue gas stream comprises introducing the first portion of the cooled residue gas stream into a third JT valve.

12. The method of claim 9, further comprising:

heating a demethanizer column overhead stream in the sixth heat exchanger to form a heated demethanizer column overhead stream, wherein the demethanizer column overhead stream comprises a substantially ethane-free residue gas stream;

compressing the heated demethanizer column overhead stream to form a compressed demethanizer column overhead stream; and cooling a portion of the compressed demethanizer column overhead stream to form a cooled residue gas return stream;

reducing a pressure of the cooled residue gas return stream using a forth JT valve to form a methane rich reflux stream; and feeding the methane rich reflux stream to the demethanizer column.

13. The method of claim 1, wherein the propane and heavier hydrocarbon stream comprises at least about 95 vol. % of the propane present within the feed stream.

14. The method of claim 1, wherein the propane and heavier hydrocarbon stream comprises at least about 99 vol. % of the C4 and heavier hydrocarbons present within the feed stream.

15. A natural gas liquids (NGL) recovery system comprising:

a deep dewpointing subsystem (DDS) configured to separate a feed stream comprising methane, ethane, and propane into a propane and heavier hydrocarbon stream and an ethane-containing residue gas stream, the DDS comprising:

a first heat exchanger configured to receive the feed stream and to output a chilled feed stream;

a feed stream separation unit configured to receive the chilled feed stream and to output a feed stream separator bottom stream and a feed stream separator overhead stream;

a first JT Valve configured to reduce the pressure of the feed stream separator overhead stream to yield a letdown feed stream separator overhead stream;

an absorber column configured to receive the letdown feed stream separator overhead stream into the absorber column and to produce an absorber bottom stream;

a first pump configured to receive the absorber bottom stream to output a pressurized absorber bottom stream;

a stripper column configured to receive the feed stream separator bottom stream and the pressurized absorber bottom stream and to output a stripper column overhead stream and a stripper column bottom stream, wherein the stripper column overhead stream comprises methane and ethane;

a second heat exchanger configured to chill the stripper column overhead stream and to heat the compressed absorber bottom stream and to output a first chilled stripper column overhead stream and a heated absorber bottom stream;

a third heat exchanger configured to further chill the first chilled stripper column overhead stream and to output a second chilled stripper column overhead stream, wherein the first heat exchanger is configured to further chill the second chilled stripper column overhead stream and to output a third chilled stripper column overhead stream, a second JT valve configured to reduce the pressure of the third chilled stripper column overhead stream to yield a lean reflux stream, wherein the lean reflux stream is fed to a top of the absorber column, and wherein the stripper column bottom stream forms the propane and heavier hydrocarbon stream and wherein the propane and heavier hydrocarbon stream comprises propane and heavier hydrocarbons and less than about 2.0% of ethane by volume.

16. The system of claim 15, wherein the absorber column is further configured to output an absorber overhead stream, wherein the absorber overhead stream forms the ethane-containing residue gas stream.

17. The system of claim 16, wherein the first heat exchanger is configured to heat the absorber overhead stream and to output a heated residue gas stream.

18. The system of claim 17, further comprising:

an ethane-recovery subsystem (ERS) configured to separate ethane from the heated residue gas stream, wherein the ERS comprises:

a first compressor configured to receive the heated residue gas stream and to output a compressed residue gas stream;

a fourth heat exchanger configured to cool the compressed residue gas stream to yield a cooled residue gas stream;

a fifth heat exchanger configured to cool a first portion of the cooled residue gas stream and to output a cooled first portion residue gas stream;

a third JT valve configured to reduce the pressure of the cooled first portion residue gas stream and to output a letdown first portion residue gas stream;

a demethanizer column configured to receive the letdown first portion residue gas stream and a methane rich reflux stream, wherein the demethanizer column is further configured to produce a demethanizer column overhead stream and a demethanizer column bottom stream, wherein the fourth heat exchanger is further configured to heat the demethanizer column overhead stream to form a heated demethanizer column overhead stream;

a second compressor configured to receive the heated demethanizer column overhead stream and to output a compressed demethanizer column overhead stream, wherein a portion of the compressed demethanizer column overhead stream is cooled in the fifth heat exchanger to form a cooled residue gas return stream;

a fourth JT valve configured to reduce the pressure of the cooled residue gas return stream to form the methane rich reflux stream;

a demethanizer reboiler heat exchange configured to cool a second portion of the chilled residue gas stream and to output a cooled second portion residue gas stream;

a residue gas separator configured to receive the cooled second portion residue gas stream and to output a residue gas separator bottom stream and a residue gas separator overhead stream;

a fifth JT valve configured to reduce the pressure of the residue gas separator bottom stream to output a letdown residue gas separator bottom stream;

wherein the demethanizer column is further configured to receive the letdown residue gas separator bottom stream into a mid-section of the demethanizer column;

a turbo-expander configured to reduce the pressure of the residue gas separator overhead stream and to output a letdown residue gas separator overhead stream;

wherein the demethanizer column is further configured to receive the letdown residue gas separator overhead stream into an upper portion thereof; and wherein the demethanizer column bottom stream comprises at least 98% ethane by volume.

19. The system of claim 18, wherein the demethanizer column overhead stream comprises a substantially ethane-free residue gas stream.

20. The system of claim 15, wherein the propane and heavier hydrocarbon stream comprises at least about 95 vol. % of the propane present within the feed stream.

21. The system of claim 15, wherein the propane and heavier hydrocarbon stream comprises at least about 99 vol. % of the C4 and heavier hydrocarbons present within the feed stream.

* * * * *